United States Patent [19]

Lange et al.

[11] 4,273,852

[45] Jun. 16, 1981

[54] INSTANT FILM UNIT

[75] Inventors: Gerald A. Lange; Charles J. Simpson, both of Rochester, N.Y.

[73] Assignee: Eastman Kodak Company, Rochester, N.Y.

[21] Appl. No.: 106,643

[22] Filed: Dec. 26, 1979

[51] Int. Cl.[3] ..... G03C 5/54; G03D 9/00

[52] U.S. Cl. ..... 430/209; 430/207; 430/208; 354/303; 354/305

[58] Field of Search ..... 354/86, 304, 305, 303; 430/207, 208, 209

[56] References Cited

U.S. PATENT DOCUMENTS

| | | | |
|---|---|---|---|
| 2,467,320 | 4/1949 | Land . | |
| 2,627,460 | 2/1953 | Land . | |
| 3,195,434 | 7/1965 | Dietz . | |
| 3,309,201 | 3/1967 | Friedman . | |
| 3,455,691 | 7/1969 | Bachelder . | |
| 3,647,441 | 3/1972 | Bachelder . | |
| 3,694,206 | 9/1972 | Downey . | |
| 3,764,332 | 10/1973 | Harvey | 430/207 |
| 4,042,395 | 8/1977 | Tone | 430/209 |
| 4,148,652 | 4/1979 | Sylvester | 354/304 |
| 4,196,000 | 4/1980 | Johnson | 354/304 |

OTHER PUBLICATIONS

Research Disclosure No. 12267, pub. Jun. 1974.

*Primary Examiner*—Mary F. Downey
*Attorney, Agent, or Firm*—John B. Turner

[57] ABSTRACT

An instant film unit, including first and second superposed sheets, and conventional internal spacers for controlling the depth of a layer of processing fluid distributed by flowing the fluid between the sheets, is provided with additional internal spacers that reduce the resistance to fluid flow and augment the quantity of fluid supplied to the lateral edges of the imaging area. In the disclosure, the first spacers comprise portions of a mask, which frames the imaging area. The additional spacers are side rails which separate the lateral edges of the sheets by an amount greater than the thickness of the mask. The film unit is adapted for use with a processing device which includes a pressure nip long enough to span the imaging area, but the side rails are outside of the pressure nip adjacent the ends thereof.

9 Claims, 7 Drawing Figures

INSTANT FILM UNIT

BACKGROUND OF THE INVENTION

The present invention relates to self-processing photographic film units, sometimes called instant film units, and to mechanisms for controlling the depth and uniformity of a layer of processing fluid distributed in such units between two sheets.

Self-processing film units typically include a pouch of processing fluid coupled to first and second superposed sheets. One of the sheets supports photosensitive material for recording a latent image that is processable by the fluid to establish a visible print. The other sheet serves as a cover to confine the fluid and to facilitate its distribution from the pouch over the photosensitive material.

The fluid is distributed by applying compressive pressure to the film unit progressively from one end to the other. This ruptures the pouch, expels the fluid between the sheets and drives it in a wave toward the opposite end of the film unit where any excess is collected in a trap. Although the distributed fluid may be quickly absorbed, it exists for some finite time as a layer which has a depth suitable, when absorbed, to carry out the processing function. It is common to measure this fluid depth, and to consider its uniformity, when analyzing related photographic effects.

Compression-resistant elements are usually employed to maintain a spacing between the sheets and thereby control the depth of the fluid layer when the compressive pressure is applied. According to one well known approach, elongate strips called side rails are provided along the lateral edges of the film unit from the pouch to the trap. Alternatively, a mask, which frames the imaging area, can serve the additional function of controlling the spacing between the sheets. Although many variables affect the depth of the distributed fluid, spacing elements such as those mentioned above, are the most influential.

The uniformity of the depth of the fluid layer is also important. The fluid tends to flow in a tongue-shaped wave ahead of the pressure mechanism. This moves more fluid down the middle of the film unit than at its edges, sometimes resulting in uneven processing. For these and other reasons, which are known to those skilled in the art, it is common to modify the distribution to direct more fluid toward the lateral edges of the picture area. In some film units the fluid pouch is sectioned or sealed in a pattern which provides more fluid at the lateral edges. In other cases the processing mechanism includes surfaces which abut the film unit near the leading end of the tongue-shaped wave to divert some of the fluid toward the lateral edges.

The above background is only representative of the numerous approaches that have been proposed for controlling the depth and the uniformity of the depth of a processing fluid layer in self-processing film units. It will become apparent from the following description, however, that none of the prior approaches offer the important advantages of the present invention.

SUMMARY OF THE INVENTION

In accordance with the present invention, a self-processing film unit, including first and second superposed sheets, is provided with internal spacing means for controlling the nominal depth and for improving the uniformity of the depth of a layer of processing fluid distributed between the sheets. In addition to first internal spacers, which control the nominal depth of the distributed fluid layer, second internal spacers are provided which do not change the nominal depth significantly, but cause the lateral edges of the sheets to be spaced apart by a distance greater than the nominal depth and thereby enhance the uniformity of the fluid depth especially adjacent the lateral edges of the imaging area.

In the preferred embodiment of the invention, the first spacer is a mask which frames the imaging area in addition to controlling the nominal depth of the distributed fluid layer. The second spacers are parallel side rails, which extend longitudinally at the lateral edges of the sheets, and separate the lateral edges by an amount greater than the mask thickness. These side rails reduce the resistance to fluid flow at the lateral edges of the film unit, and temporarily accommodate more fluid there. The temporarily accommodated fluid is then redistributed to augment the quantity of fluid supplied to the lateral edges and trailing end corners of the imaging area.

The film unit is adapted for use with a processing device which includes a pressure nip having a predetermined length sufficient to span the aperture in the mask but not the lateral spacing between the side rails. During processing, when the film unit moves progressively through the nip, the pressure at the nip is exerted against the mask through the first and second sheets to control the nominal fluid depth. The side rails are outside the nip, adjacent the ends thereof, and receive little of the pressure. In that location the side rails provide a more uniform fluid depth without substantially affecting the nominal value.

Still other aspects of the invention, and more specific features, will become apparent to those skilled in the art from the following detailed description of the preferred embodiment considered together with the accompanying drawings.

BRIEF DESCRIPTION OF THE DRAWINGS

Reference is made to the accompanying drawings, in which.

DETAILED DESCRIPTION OF PREFERRED EMBODIMENT

Figure 4:
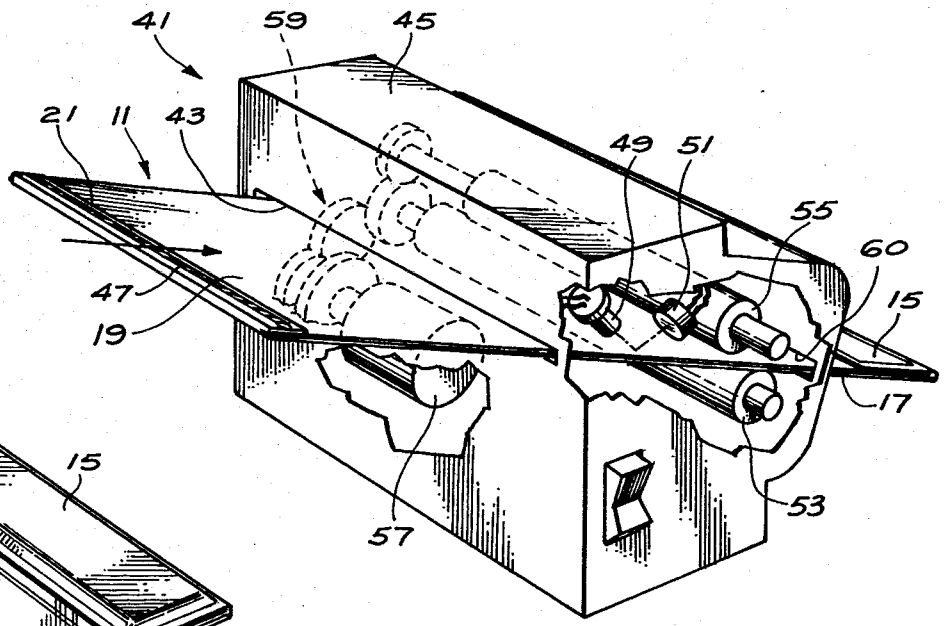
FIG. 4 is a mechanism for initiating processing of the film unit depicted in FIG. 1, including a pair of juxtaposed rollers for applying compressive pressure to the film unit progressively from one end of the film unit to the other.
Figure 1:
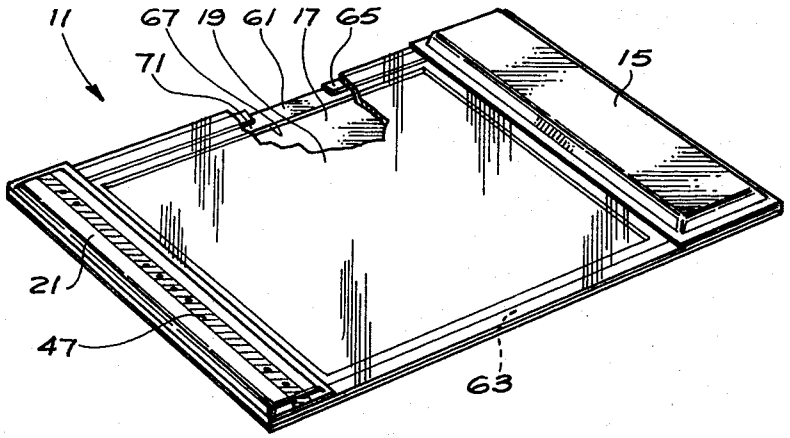
FIG. 1 is a perspective view of a self-processing film unit according to a preferred embodiment of the present invention.

Referring now to the drawings, a preferred embodiment of the invention as depicted in FIGS. 1 and 5–7, comprises a self-processing film unit 11 including a pouch 15 of processing fluid coupled to first and second superposed sheets 17 and 19. Sheet 17 carries several layers of photosensitive material, and dyes, for recording a latent image that is processable by the fluid to form a photographic print. Sheet 19 serves as a cover to confine the fluid, and aids in its distribution over the photosensitive layers. The cover sheet may also include various timing and neutralizing layers which control the duration of the print-forming reaction.

When used with an appropriate camera (not shown), the photosensitive sheet is exposed through the cover sheet, which is transparent, to record the latent image. Compressive pressure is then applied to the film unit, progressively from one end to the other, to rupture the pouch, expel the fluid into the confined area between the sheets, and drive the fluid longitudinally across the film unit toward trap 21. The processing fluid permeates the various layers, photographically develops the latent image, and, in accordance with such development, brings about a selective image-wise migration of the dyes to a receiving layer where they are immobilized to form the multi-color print.

Although the image-receiving layer can be in the cover sheet, where the final print would be viewed from the exposed face of the film unit, the preferred embodiment employs such layer in the photosensitive sheet for viewing from the face opposite the exposed face.

Since such film units are well known to those skilled in the art, a detailed description of the processing reaction is not considered necessary. It should be recognized, however, for the purpose of understanding the present invention, that the image forming process is dependent on the availability to the photosensitive material of an appropriate quantity of the processing fluid, which requires a certain nominal depth and uniformity of the depth of the distributed fluid layer. The term "nominal" is used here to mean an aim point or par value for the fluid depth.

Figures 2, 3:
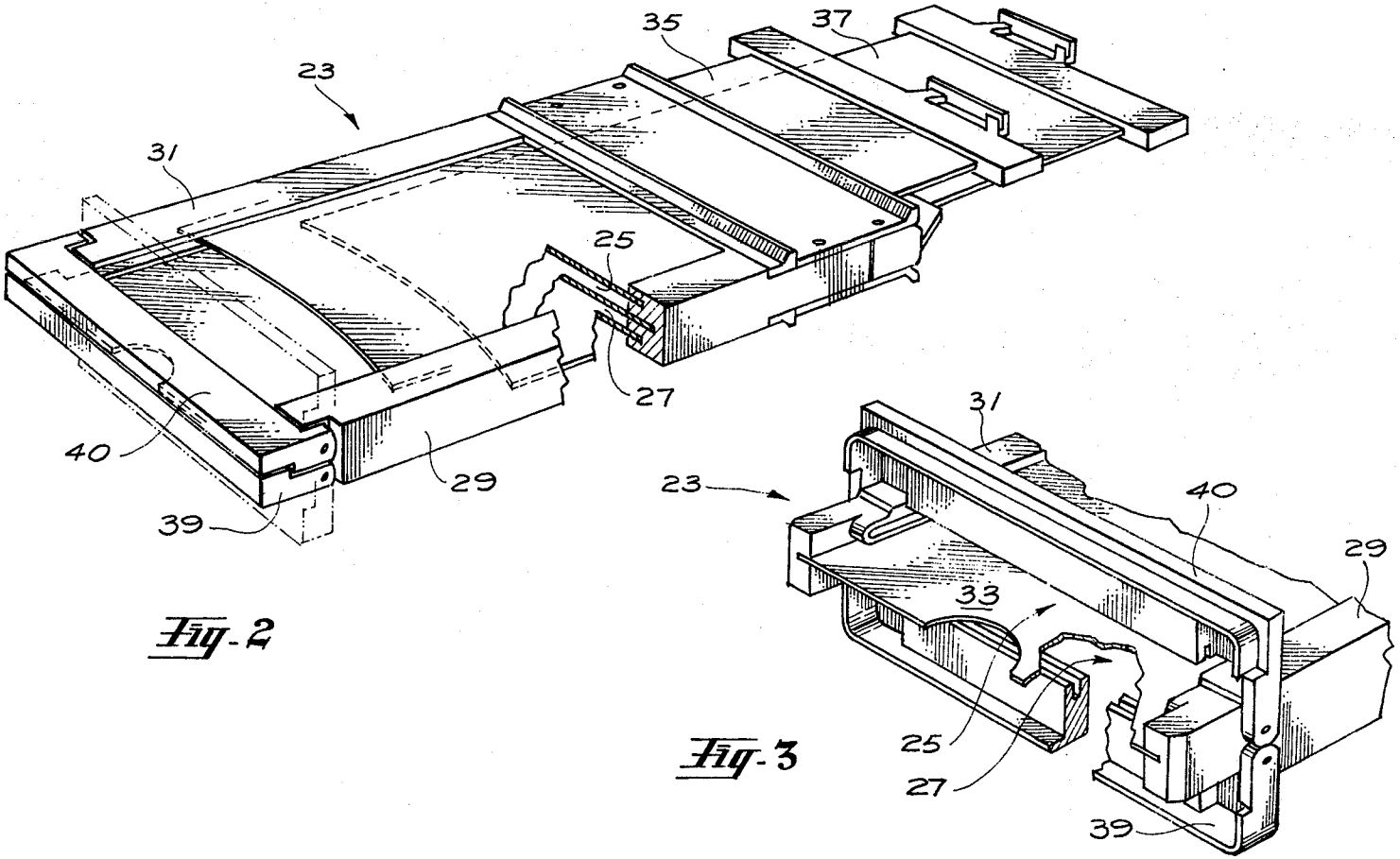
FIGS. 2 and 3 are perspective and partial perspective views, with parts broken away, depicting a film holder in which the film unit of FIG. 1 is adapted to be exposed in a suitable camera (not shown), before processing.

Referring now to FIGS. 2 and 3, a film holder 23 is depicted for receiving and properly locating film units of the preferred type on a press camera or the like (not shown). The holder is adapted to be loaded in a dark room with two film units, one in each of two light-tight chambers 25 and 27. The chambers protect the film units from premature exposure, while the external surfaces of the holder facilitate its attachment and use on the camera.

The holder comprises two framing elements 29 and 31 which carry a fixed central divider 33 and first and second slidable covers 35 and 37. Chamber 25 is thus formed between the divider 33 and one cover 35, while chamber 27 is between the same divider and the other cover 37. When the covers are closed, the chambers are sealed to exclude light. When opened, they uncover the chambers, presenting the film units for exposure.

The chambers are also accessible through two end caps 39 and 40, which are pivotably mounted on the framing elements for movement between open film-loading positions (FIG. 3), and closed light-tight positions (FIG. 2).

In operation, the end caps 39 and 40 are opened, and the holder is loaded in a darkroom by sliding film units endwise, past the end caps, into each of the chambers 25 and 27. The end caps are closed and the holder is removed from the darkroom and positioned on a camera back with one of the film units facing the camera's exposure mechanism. Assuming the film unit in chamber 25 is the first to be exposed, cover 35 is removed and the camera is operated to make the exposure. The cover is closed to protect the film unit, the back is turned over to present the other film unit for exposure, and the process described above for the exposing the first film unit is repeated to expose the second film unit. After both units are exposed, they are removed from the holder in a dark room for processing in apparatus 41 (FIG. 4).

The processing apparatus, like the film holder, is intended for darkroom loading. The exposed film units are removed from the film holder manually and inserted into the apparatus through a slot 43 in housing 45. An infra-red reflective strip 47 is provided across one face of the film unit, at the trap end, for automatic vertification that the film unit is properly oriented relative to the apparatus. An infra-red source 49 is positioned to direct radiation against the film unit adjacent a photocell 51. When the film unit is inserted trap end first, or with the wrong side up, the source radiation is reflected from the film unit and sensed by the photocell to disable the apparatus. The photosensitive sheet 17 is a reflector of infra-red, so no additional reflecting strip is required on that side. When the film unit is properly inserted, on the other hand, non-reflecting surfaces are presented to the source and the apparatus is not disabled.

Assuming the film unit is properly positioned in the apparatus, the leading end is pushed into the nip between a pair of juxtaposed pressure rollers 53 and 55 to apply compressive pressure to the film unit progressively from one end to the other. The rollers, which are rotated by an electric, battery driven motor 57, through gear train 59, transport the unit through the nip and thereby rupture the pouch and drive its fluid contents between the sheets. The film unit exits from the apparatus through a second slot 60 for retrieval and viewing after processing.

Figure 5:
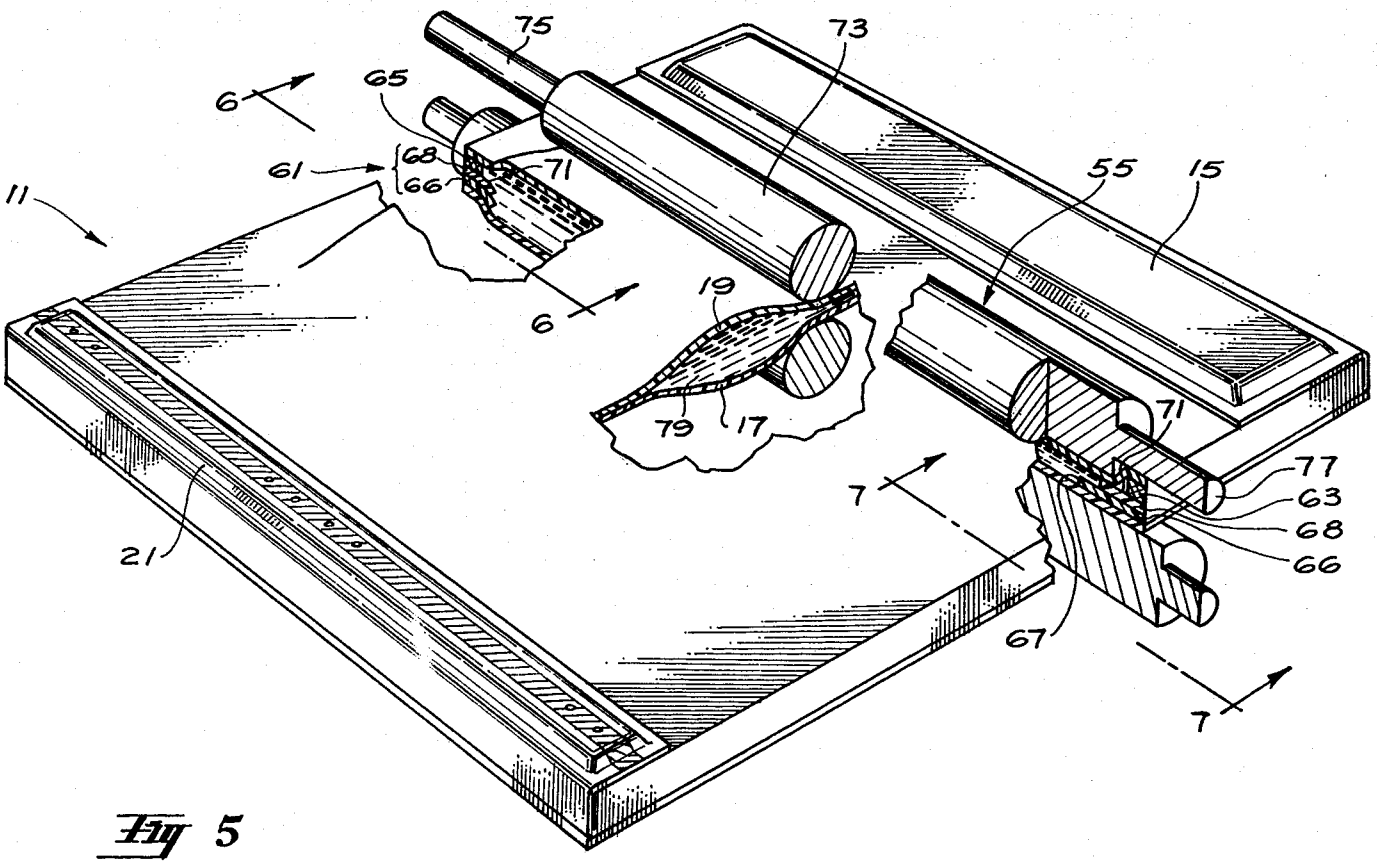
FIG. 5 is an enlarged perspective view of the film unit depicted in FIG. 1, including a portion of the processing mechanism depicted in FIG. 4, with pieces of the film unit and mechanism broken away or sectioned to show the fluid wave as it is driven by the mechanism between the sheets.
Figure 7:
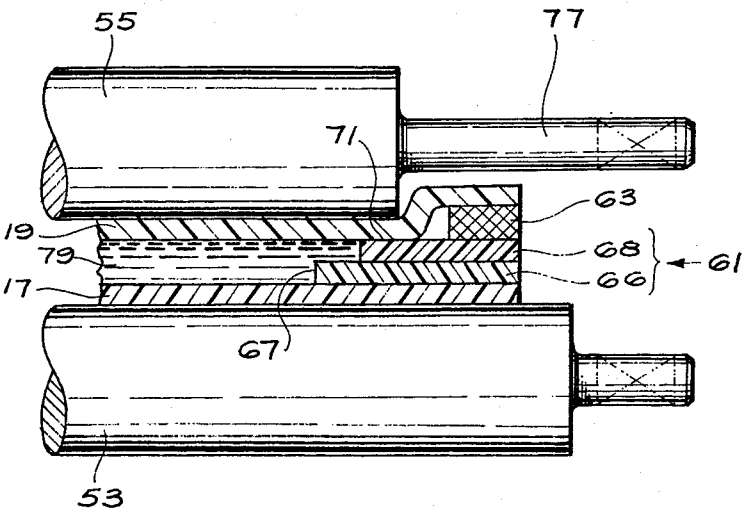
FIGS. 6 and 7 are partial cross-sectional views taken along lines 6—6 and 7—7, respectively, in FIG. 5.
Figure 6:
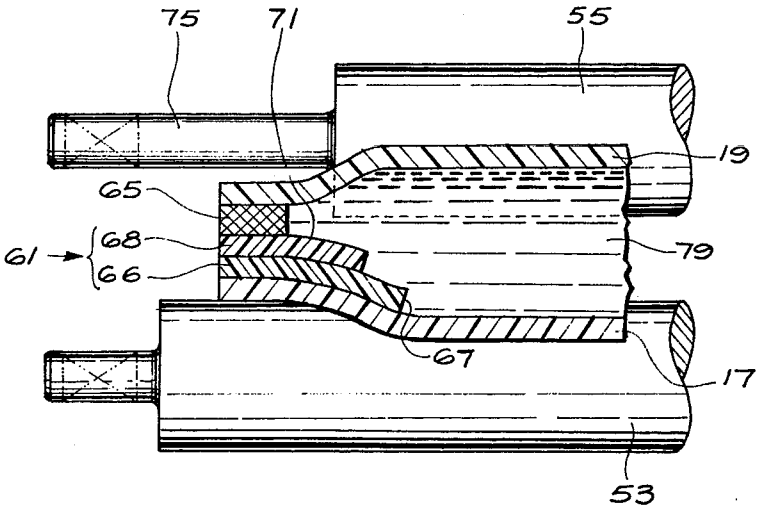

Referring again to the film unit, and more particularly to FIGS. 5–7, the photosensitive and cover sheets are permanently coupled together by internal structure that includes a mask 61 and side rails 63 and 65.

The mask is actually two pieces or strips of sheet material, one on top of the other, which extend around the entire perimeter of the film unit. The first piece 66 defines a rectangular aperture 67 and frames the imaging area of the film unit to provide sharp, straight edges between the print and a white surrounding border. The second piece 68 is slightly narrower than the first piece and adds to the thickness of the mask to control the depth of the distributed fluid layer. Both pieces are constructed of a compression resistant material in a thickness suitable for spacing the sheets apart by the desired amount under the compressive pressure of the processing mechanism.

The side rails 63 and 65 are two parallel strips of spacing material which lie on top of the mask between the mask and the cover sheet. They are spaced laterally on opposite sides of the mask aperture and extend longitudinally, at both of the lateral edges of the film unit, from adjacent the fluid pouch to adjacent the trap. The rails are narrower than the narrowest mask piece to reveal a mask ledge 71. This ledge should be suitably wide to carry the pressure of the processing mechanism between the side rails so the mask, rather than the side rails, can control the average depth of the distributed fluid layer.

In order to ride on the mask ledge 71, the nip between the pressure rollers 53 and 55 of the processing mechanism is made sufficiently long to span the aperture in the mask, but not the distance between the side rails. This is accomplished by what is commonly referred to as a stepped roller, which has a central section 73 of one diameter, defining the pressure nip, and end sections 75 and 77 of reduced diameter of accommodate the thickness of the side rails. Thus, while the rollers engage the sheets between the side rails and press the sheets toward one another against the mask ledge, they exert little or no compressive pressure on the side rails, which are outside the nip adjacent its ends.

The thickness of the mask normally will be approximately the same as the desired depth of the distributed fluid layer, but not necessarily exactly the same, since compression and bending of the film unit parts, as they move through the apparatus, also will have an effect on the depth of the fluid layer. It is the mask thickness, however, coupled with other physical properties of the film unit, and its physical handling in the apparatus, that controls the nominal depth of the fluid layer.

The side rails have little, if any, effect on the nominal depth, but they have an important effect on the uniformity of the depth especially adjacent the lateral edges of the imaging area and at its trailing end corners. The side rail thickness provides additional spacing between the sheets at the lateral edges of the film unit, which temporarily accommodates an excess of the processing fluid there, beyond the periphery of the imaging area. This fluid is then displaced when it moves into the nip and augments the quantity of fluid supplied to the periphery of the imaging area.

More specifically, and referring to the operation of a film unit according to the present invention, as the fluid is driven between the sheets by the pressure mechanism, a wave 79 (FIG. 5) of the fluid bows the sheets apart ahead of the rollers. This wave extends laterally across the image-recording area to the side rails 63 and 65, covering the mask ledge 71 on both sides of the mask aperture 67. As depicted most clearly in FIG. 6, the side rails temporarily accommodate an excess of the processing fluid at the lateral edges of the image-recording area. Similarly, the increased spacing between the sheets reduces the resistance to fluid flow at the lateral edges. Then, as the film unit moves through the pressure mechanism, the sheets are pressed against the mask, displacing the fluid from ledge 71 and augmenting the fluid provided to the lateral edges of the image-recording area.

It is believed that the major contribution of the side rails is to enhance the distribution of the processing fluid at the lateral edges of the imaging area. The side rails may, however, also have other effects. When the sheets are bowed apart by the fluid wave that is driven ahead of the pressure mechanism, the greater spacing at the lateral edges of the film unit translates, of course, into a greater spacing between the sheets in the image-recording area as well. Thus, the wave that leads the fluid as it is driven between the sheets will be higher, and the resistance to its movement will be reduced. These effects may also contribute to the improvement in the distributed fluid pattern.

Although the specific dimensions of the mask and side rails will depend on the particular film unit and its chemistry, in the preferred film unit the first mask piece 66 is 0.0023 inches thick by 0.250 inches wide, the second mask piece 68 is 0.0026 inches thick and 0.200 inches wide, and the side rails are 0.0027 inches thick by 0.050 inches wide. Thus the total mask thickness is approximately 0.0049 inches thick and the mask ledge 71 is approximately 0.150 inches wide.

It should now be apparent that the structure of the present invention provides important advantages for distributing a processing fluid between two sheets in self-processing film units. The resistance to fluid flow between the sheets is reduced, and additional fluid is temporarily accommodated adjacent the later edges of the film unit, improving the uniformity of the fluid distribution and thereby improving the processing of the final print.

Although the invention has been described with particular reference to a preferred embodiment thereof, it will be readily understood that variations and modifications can be effected within the spirit and scope of the invention as described hereinabove and as defined in the appended claims. The invention could be employed, for example, in larger formats than presently available, or in transparencies, or in peel-apart film units where the final print is stripped from the remainder of the film unit after processing.

We claim:

1. In a film unit including first and second superposed sheets, said first sheet carrying photosensitive material for recording a processable latent image and said second sheet serving to aid in the distribution of a processing fluid over the photosensitive material, said film unit further including a mask between said sheets having an aperture defining an imaging area, side rails between said sheets spaced laterally on opposite sides of the aperture, and a pouch at one end of the imaging area for supplying the processing fluid; such film unit being adapted for use with processing apparatus which includes a pressure nip of predetermined length sufficient to span the aperture for rupturing the pouch and distributing the fluid between the sheets across the imaging area; the film unit improvement comprising:

said mask having a predetermined thickness for controlling the nominal depth of the distributed processing fluid;

said side rails having a predetermined thickness spacing the lateral edges of the sheets apart by an amount significantly greater than the nominal depth of the distributed fluid; and said lateral spacing between said side rails being slightly greater than the length of the pressure nip, whereby said rails are disposed outside of the nip during the distribution of the processing fluid where they accommodate fluid of greater depth than said nominal depth ahead of the nip and enhance the uniformity of the distribution controlled by the mask.

2. The film unit improvement claimed in claim 1, wherein said mask extends to the lateral edges of the film unit and said side rails lie between said mask and one of said sheets, said side rails plus said mask establishing said lateral edge spacing of the sheets which is greater than the nominal depth of the distributed fluid.

3. The film unit improvement claimed in claim 1, wherein said mask includes a ledge of said predetermined mask thickness for spacing said sheets apart and an edge of reduced thickness immediately adjacent the imaging area for framing the imaging area.

4. In a film unit for use in photographic apparatus having a pressure nip of predetermined length through which the film unit is movable progressively from one end to the other to distribute a processing fluid between first and second sheets of the film unit to process an image in an area on one of said sheets; said film unit including between said sheets a mask which frames the imaging area, and generally parallel side rails spaced laterally on opposite sides of the imaging area; the improvement comprising;

said mask having a predetermined thickness for spacing said sheets apart in the pressure nip to control the depth of the distributed fluid;

said lateral spacing between said side rails being slightly greater than the length of the pressure nip to position the rails outside of the nip during movement of the film unit through the nip without substantially changing the spacing between the sheets in the nip; and said side rails having a predetermined thickness which spaces the lateral edges of the sheets apart by an amount greater than the predetermined mask thickness to accommodate processing fluid temporarily adjacent said rails, which accommodated fluid is then displaced by the pressure nip to augment the fluid distributed to the imaging area adjacent the mask.

5. The film unit improvement claimed in claim 4, wherein said mask extends to the lateral edges of the film unit and said side rails lie between said mask and one of said sheets, said side rails plus said mask establishing said lateral edge spacing of the sheets which is greater than the depth of the distributed fluid.

6. In a film unit including a photosensitive sheet for recording a latent image processable by a distributed fluid composition, a second sheet coupled to said photosensitive sheet for assisting in distributing the fluid, and first and second spacing means between the sheets extending longitudinally along each lateral border of the film unit for controlling the fluid distribution; the improvement comprising:

said first spacing means having a predetermined thickness of establishing a predetermined depth of the processing fluid distributed between said sheets, and said second spacing means being located laterally outside of said first spacing means for spacing the lateral edges of the sheets apart by an amount greater than the predetermined depth of the distributed processing fluid.

7. The film unit improvement claimed in claim 6, wherein said first spacing means is a mask for framing and providing a border around the recorded image.

8. The film unit improvement claimed in claim 7, wherein said mask extends to the lateral edges of the film unit and said rails lie between said mask and one of said sheets, said side rails plus mask establishing said spacing of the lateral the sheets which is greater than the predetermined depth of the distributed processing fluid.

9. In a film unit including first and second sheets, a frame between said sheets providing a border around a picture area, side rails between said sheets on opposite sides of the picture area, and a pouch at one end of the picture area for supplying processing fluid between the sheets and between the side rails; the improvement wherein:

said frame has a predetermined thickness for establishing a predetermined depth of processing fluid between said sheets, and said side rails and said frame space the lateral edge of the sheets apart by an amount significantly greater than the predetermined depth of processing fluid.

* * * * *

UNITED STATES PATENT AND TRADEMARK OFFICE

CERTIFICATE OF CORRECTION

PATENT NO. : 4,273,852

DATED : June 16, 1981

INVENTOR(S) : Gerald R. Lange and Charles J. Simpson

It is certified that error appears in the above—identified patent and that said Letters Patent is hereby corrected as shown below:

Title page, Item [75] "Gerald A. Lange" should read --Gerald R. Lange--.

Column 8, line 19, after "lateral" insert --edges of--.

Signed and Sealed this

*Fifteenth* Day of *December 1981*

[SEAL]

*Attest:*

GERALD J. MOSSINGHOFF

*Attesting Officer*

*Commissioner of Patents and Trademarks*